US006679726B1

(12) United States Patent
Tunn et al.

(10) Patent No.: US 6,679,726 B1
(45) Date of Patent: Jan. 20, 2004

(54) PANEL MOUNTED ELECTRICAL CONNECTOR

(75) Inventors: Patrick Tunn, Loughrea (IE); Padraig McDaid, Clarina (IE); John Wallace, Racefield (IE); Joseph McCarthy, Capamore (IE); Mari Reyes, Monaleen (IE); Eddie O'Neill, Quin (IE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/304,733

(22) Filed: Nov. 26, 2002

(51) Int. Cl.[7] ..... H01R 13/73

(52) U.S. Cl. ..... 439/565; 439/550; 439/557

(58) Field of Search ..... 439/248, 550, 439/552, 553, 557, 562, 563, 916, 246, 252, 247, 544, 565

(56) References Cited

U.S. PATENT DOCUMENTS

| | | | | | |
|---|---|---|---|---|---|
| 3,091,748 | A | | 5/1963 | Takes et al. | 339/65 |
| 3,094,364 | A | | 6/1963 | Lingg | 339/64 |
| 3,235,834 | A | * | 2/1966 | O'Keefe et al. | 439/585 |
| 3,366,920 | A | * | 1/1968 | Laudig et al. | 439/581 |
| 3,686,623 | A | * | 8/1972 | Nijman | 439/584 |
| 4,112,282 | A | | 9/1978 | Piber | 200/296 |
| 4,173,384 | A | * | 11/1979 | Phillips | 439/448 |
| 4,227,765 | A | | 10/1980 | Neumann et al. | 339/143 |
| 4,580,862 | A | * | 4/1986 | Johnson | 439/248 |
| 4,697,859 | A | | 10/1987 | Fisher, Jr. | 439/246 |
| 4,734,046 | A | * | 3/1988 | McAllister et al. | 439/101 |
| 4,867,698 | A | | 9/1989 | Griffiths | 439/317 |
| 5,167,520 | A | | 12/1992 | Henry et al. | 439/266 |
| 5,383,798 | A | * | 1/1995 | Lin | 439/578 |
| 5,516,303 | A | | 5/1996 | Yohn et al. | 439/248 |
| 5,769,652 | A | | 6/1998 | Wider | 439/248 |
| 5,944,548 | A | | 8/1999 | Saito | 439/248 |
| 6,224,407 | B1 | | 5/2001 | Dugquerroy et al. | 439/188 |
| 6,344,736 | B1 | * | 2/2002 | Kerrigan et al. | 324/158.1 |

FOREIGN PATENT DOCUMENTS

| | | |
|---|---|---|
| GB | 2 128 038 | 4/1984 |

* cited by examiner

*Primary Examiner*—P. Austin Bradley
*Assistant Examiner*—X. Chung-Tranb
(74) *Attorney, Agent, or Firm*—Stephen Z. Weiss

(57) ABSTRACT

An electrical connector is provided for mounting through an aperture in a panel with floating movement between the connector and the panel. A connector housing includes a mating portion insertable from a first side of the panel, through the aperture, to a position projecting from a second side of the panel. A first projection on the housing is engageable with the first side of the panel. A spring retention cap is positioned about the mating portion on the second side of the panel and includes a second projection for engaging the second side of the panel. An extension spring has opposite ends fixed to the spring retention cap and to the housing for drawing the first projection on the housing and the second projection on the spring retention cap against the first and second sides of the panel.

12 Claims, 3 Drawing Sheets

PANEL MOUNTED ELECTRICAL CONNECTOR

FIELD OF THE INVENTION

This invention generally relates to the art of electrical connectors and, particularly, to an electrical connector for mounting through an aperture in a panel and provided with floating movement between the connector and the panel.

BACKGROUND OF THE INVENTION

Various electrical connectors have been designed for mounting through an aperture in a panel. For instance, a connector housing may be disposed at a first or rear side of the panel, with a mating portion of the connector projecting through the aperture to a position projecting from a second or front side of the panel. Often, it is desirable that the connector "float" relative to the panel. In other words, the connector can move within the aperture relative to the panel.

Panel mounted electrical connectors of the character described above, particularly when provided with floating movement, typically are unnecessarily complicated to manufacture and/or use. Extraneous brackets may have to be provided, and the connector takes up too much area or "real estate" on the panel. The present invention is directed to solving these problems by providing a very simple connector which is mounted in an aperture in a panel, with floating movement between the connector and the panel, simply by inserting the connector through the aperture in the panel.

SUMMARY OF THE INVENTION

An object, therefore, of the invention is to provide a new and improved panel mounted electrical connector of the character described.

Another object of the invention is to provide a new and improved electrical connector for mounting through an aperture in a panel, with floating movement between the connector and the panel.

In the exemplary embodiment of the invention, a connector housing includes a mating portion insertable from a first side of the panel, through the aperture, to a position projecting from a second side of the panel. A first projection is provided on the housing for engaging the first side of the panel. A spring retention cap is positioned about the mating portion on the second side of the panel and includes a second projection for engaging the second side of the panel. An extension spring has opposite ends fixed to the spring retention cap and to the housing for drawing the first projection on the housing and the second projection on the spring retention cap against the first and second sides of the panel. The extension spring provides for floating movement between the connector and the panel.

According to one aspect of the invention, the extension spring is a coil spring stretched in tension between the housing and the spring retention cap. The cap is cup-shaped to define an inner bottom wall and side walls forming an interior cavity within which the coil spring is disposed. One end of the spring is fixed to the inner bottom wall of the cup-shaped spring retention cap. The mating portion of the connector housing extends through an opening in the bottom wall of the cup-shaped spring retention cap.

According to another aspect of the invention, the spring retention cap is dimensioned for passing through the aperture in the panel when the mating portion of the connector housing is inserted from the first side of the panel through the aperture. The second projection on the spring retention cap passes through the panel into snapped engagement with the second side of the panel. The second projection is located on a compressible portion of the spring retention cap, whereby the second projection snappingly expands into engagement with the second side of the panel when the second projection clears the aperture in the panel.

As disclosed herein, the first projection on the housing is provided by a peripheral flange which may be press-fit onto the mating portion of the connector housing. Alternatively, the flange may be integral with and surround the mating portion of the connector housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
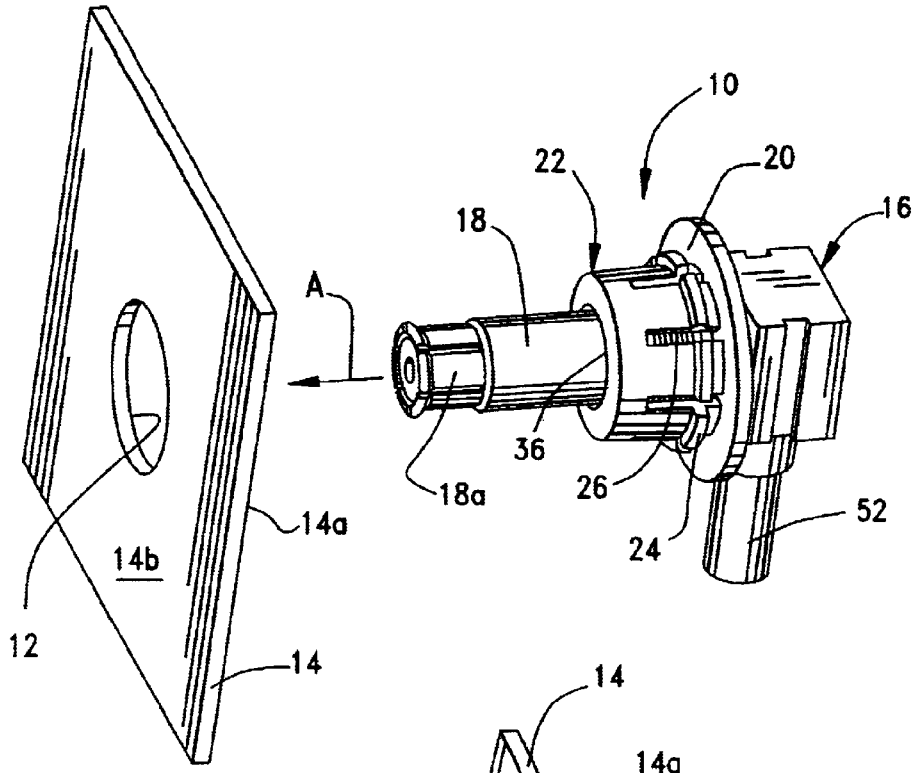
FIG. 1 is a perspective view of an electrical connector according to the invention, with the connector about to be inserted into an aperture in a panel.
Figure 2:
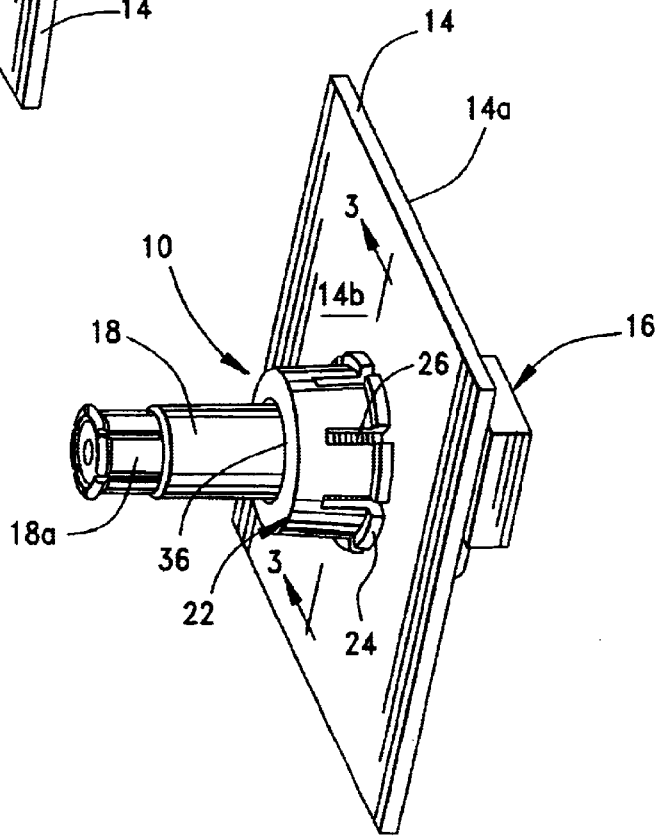
FIG. 2 is a view similar to that of FIG. 1, with the connector inserted through the aperture and fully mounted to the panel.

Referring to the drawings in greater detail, and first to FIG. 1, the invention is embodied in an electrical connector, generally designated 10, for mounting through an aperture 12 in a panel 14 in the direction of arrow "A". FIG. 2 shows the connector fully mounted within the aperture in the panel, and floating movement is provided between the connector and the panel.

Figure 3:
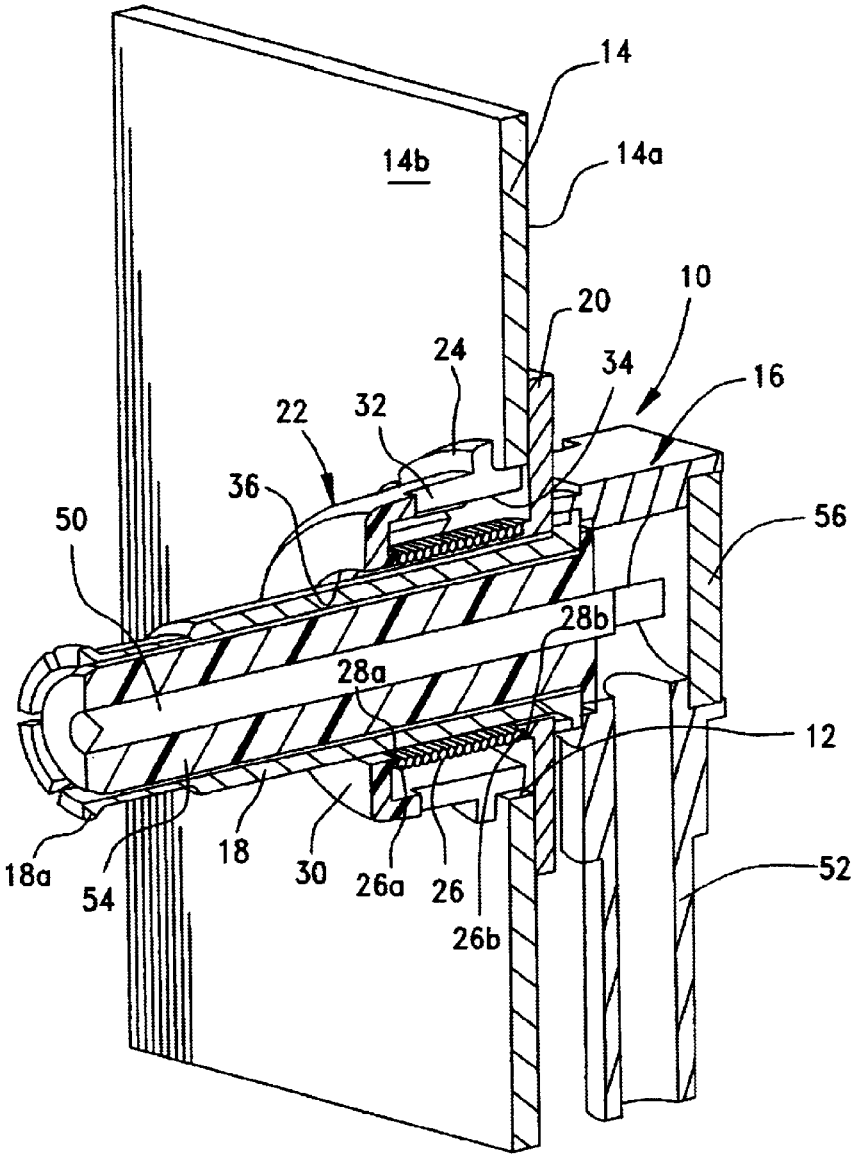
FIG. 3 is an enlarged vertical section taken generally along line 3—3 of FIG. 2.

Referring to FIG. 3 in conjunction with FIGS. 1 and 2, electrical connector 10 includes a connector housing, generally designated 16, which has a mating portion 18 which is insertable in the direction of arrow "A" (FIG. 1) from a first or rear side 14*a* of panel 14, through aperture 12, to a position projecting from a second or front side 14*b* of the panel as seen in FIGS. 2 and 3. Housing 16 has a first projection in the form of a peripheral flange for engaging rear side 14*a* of the panel as seen in FIG. 3.

A spring retention cap, generally designated 22, is positioned about mating portion 18 and, when the connector is mounted through the aperture in the panel, the spring retention cap is located at the front side 14*b* of the panel and includes a second projection in the form of a peripheral flange 24 for engaging the front side of the panel.

As best seen in FIG. 3, an extension spring 26 has opposite ends 26*a* and 26*b*, respectively, fixed to spring retention cap 22 and to flange 20 of housing 16. In the illustrated embodiment, extension spring 26 is a coil spring stretched in tension between the spring retention cap and the housing. Opposite ends 26*a* and 26*b* of the coil spring are hooked into holes 28*a* and 28*b*, respectively, in the spring retention cap and flange 20 to maintain the spring in its extended or stretched condition. Therefore, the spring is effective for drawing the first projection (flange) 20 on housing 16 and the second projection (flange) 24 on spring retention cap 22 against the first and second sides 14*a* and 14*b*, respectively, of panel 14.

Figures 4, 5:
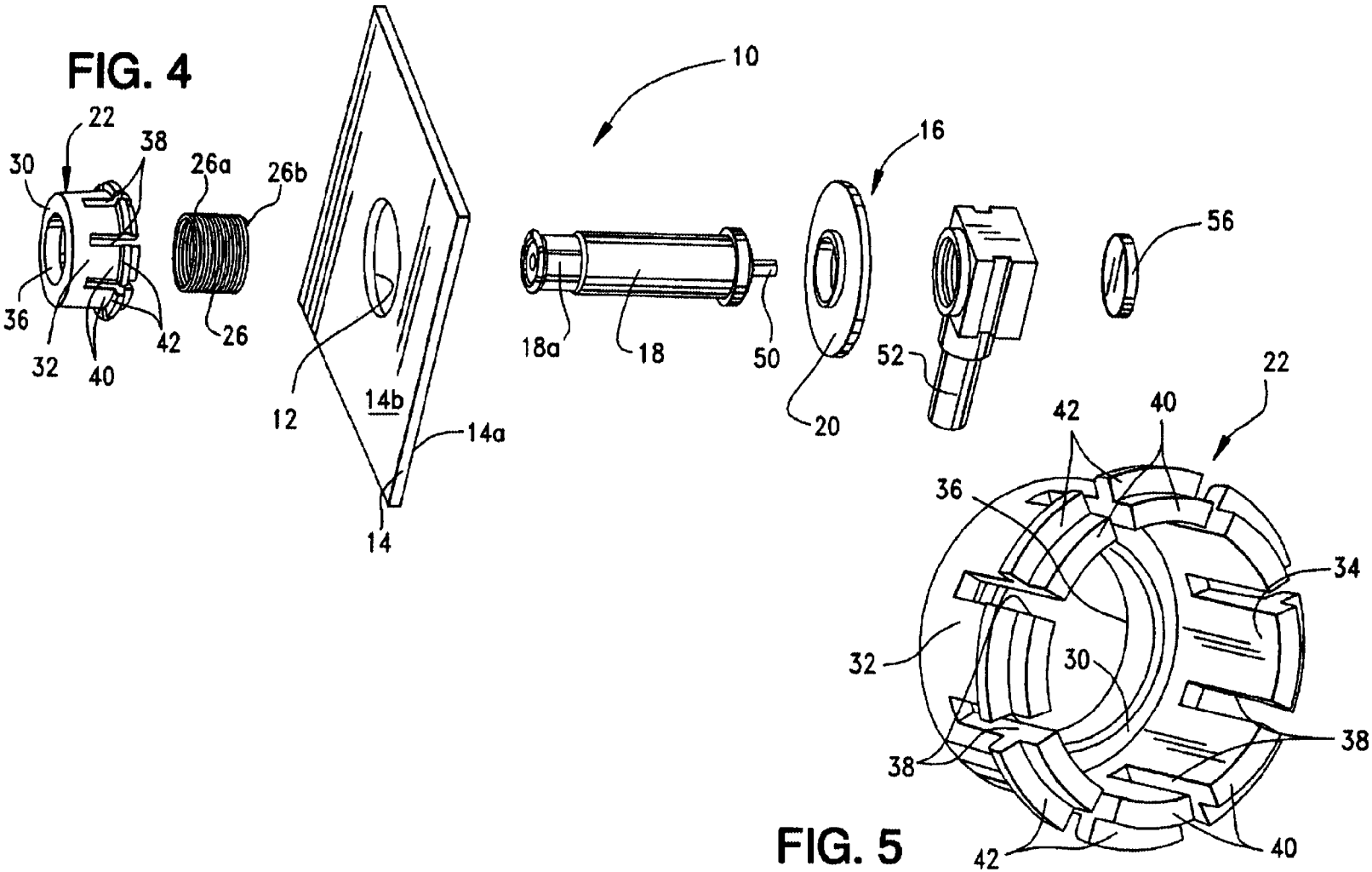
FIG. 4 is an exploded perspective view showing the components of the connector in conjunction with the panel.
FIG. 5 is an enlarged perspective view of the spring retention cap of the connector.

Referring to FIG. 5 in conjunction with FIG. 3, it can be seen that spring retention cap 22 is generally cup-shaped to define an inner bottom wall 30 and a cylindrical side wall 32 which forms an interior cavity 34 within which coil spring 26 is disposed. End 26*a* of the coil spring is fixed to inner bottom wall 30 of the cup-shaped spring retention cap. The bottom wall includes an opening 36 through which mating portion 18 of connector 10 extends.

Spring retention cap 22 is dimensioned for passing through aperture 12 in panel 14 when mating portion 18 of the connector is inserted from rear side 14*a* of the panel through the aperture. The inner end of the spring retention cap is compressible by providing a plurality of slits 38 which effectively define a plurality of flexible fingers 40 circumferentially about the retention cap. The second projection 24 (FIG. 3) for engaging front side 14*b* of panel 14 actually is defined by a plurality of flange sections 42 as seen in FIG. 5, with the flange sections projecting outwardly from flexible fingers 40. Therefore, when the connector is inserted through aperture 12 in panel 14 in the direction of arrow "A" (FIG. 1), flexible fingers 40 flex inwardly to compress the inner end of the spring retention cap and allow flange sections 42 to pass through the aperture. When the flange sections clear the aperture, flexible fingers 40 "snap" back outwardly so that flange sections 42 form the second projection 24 (FIG. 3) for engaging front side 14*b* of the panel.

With the unique structural arrangement of spring retention cap 22 and extension spring 26 described above, electrical connector 10 can take a wide variety of configurations. For instance, connector 10 herein is structured as an antenna connector for use with mobile cell phones or the like. To that end, the connector includes a central terminal 50 (FIG. 3) which is coupled to a coaxial cable (not shown) which extends into the connector through a rear boot 52. The boot is secured to connector housing 16 which, itself, can take a variety of configurations. For instance, mating portion 18 is shown as a separate component (see FIG. 4) of housing 16, but the mating portion could be an integral portion of the housing. Terminal 50 is surrounded by a dielectric 54 which is disposed within the mating portion. A sealing cap 56 closes the rear of housing 16, and a front distal end 18*a* of mating portion 18 is compressible for mating with a complementary connector (not shown). Repeating, all of these various components of connector 10 and connector housing 16 can be varied considerably within the concepts of the invention.

Finally, the first projection provided by peripheral flange 20 on connector housing 16 for engaging rear side 14*a* of panel 14 also can vary from the configuration shown in the drawings. For instance, flange 20 may be press-fit about mating portion 18 of the connector housing. Alternatively, the peripheral flange may be integral with the mating portion or other portions of the connector housing.

When connector 10 is mounted within aperture 12 in panel 14 as seen in FIGS. 2 and 3, spring retention cap 22 and connector housing 16 can move relative to each other because the connection therebetween is provided solely by extension spring 26. Therefore, the connector can "float" or move relative to panel 14 both axially as well as radially within aperture 12. In addition, the entire connector can rotate or twist about an axis through the center of the aperture relative to the panel.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for mounting through an aperture in a panel with floating movement between the connector and the panel, comprising:

a connector housing including a mating portion insertable from a first side of the panel, through the aperture, to a position projecting from a second side of the panel, and a first projection on the housing for engaging the first side of the panel;

a spring retention cap positioned about the mating portion on the second side of the panel and including a second projection for engaging the second side of the panel, the spring retention cap dimensioned for passing through the aperture in the panel when the mating portion of the connector housing is inserted from the first side of the panel through the aperture, said second projection on the spring retention cap passing through the aperture in the panel into snapped engagement with the second side of the panel; and an extension spring having opposite ends fixed to the spring retention cap and to the housing for drawing the first projection on the housing and the second projection on the spring retention cap against the first and second sides of the panel.

2. The electrical connector of claim 1 wherein said extension spring comprises a coil spring stretched in tension between the housing and the spring retention cap.

3. The electrical connector of claim 1 wherein said spring retention cap is cup-shaped to define an inner bottom wall and side walls forming an interior cavity within which said extension spring is disposed.

4. The electrical connector of claim 3 wherein one end of said extension spring is fixed to the inner bottom wall of the cup-shaped spring retention cap.

5. The electrical connector of claim 3 wherein said mating portion of the connector housing extends through an opening in the bottom wall of the cup-shaped spring retention cap.

6. The electrical connector of claim 1 wherein said second projection is located on a compressible portion of the spring retention cap whereby the second projection expands into engagement with the second side of the panel when the second projection clears the aperture in the panel.

7. The electrical connector of claim 1 wherein said first projection comprises a peripheral flange press-fit onto the mating portion of the connector housing.

8. The electrical connector of claim 1 wherein said first projection comprises a peripheral flange integral with and surrounding the mating portion of the connector housing.

9. An electrical connector for mounting through an aperture in a panel with floating movement between the connector and the panel, comprising:

a connector housing including a mating portion insertable from a first side of the panel, through the aperture, to a position projecting from a second side of the panel, and a first projection on the housing for engaging the first side of the panel;

a spring retention cap positioned about the mating portion on the second side of the panel and including a second projection for engaging the second side of the panel, the spring retention cap being cup-shaped to define an inner bottom wall and side walls forming an interior cavity with the mating portion of the connector extending through an opening in the bottom wall, and the retention cap being dimensioned for passing through the aperture in the panel when the mating portion of the connector housing is inserted from the first side of the panel through the aperture, said second projection being located on a compressible portion of the spring retention cap whereby the second projection expands into engagement with the second side of the panel when the second projection clears the aperture in the panel; and a coil spring stretched in tension between the housing and the spring retention cap and including opposite ends fixed to the inner bottom wall of the spring retention cap and to the housing for drawing the first projection on the housing and the second projection on the spring retention cap against the first and second sides of the panel.

10. The electrical connector of claim 9 wherein said first projection comprises a peripheral flange press-fit onto the mating portion of the connector housing.

11. The electrical connector of claim 9 wherein said first projection comprises a peripheral flange integral with and surrounding the mating portion of the connector housing.

12. The electrical connector of claim 9 wherein said compressible portion of the spring retention cap is slit to define flexible fingers with said second projection being provided by flange means on at least some of the flexible fingers.

* * * * *